US006652680B2

(12) United States Patent
Grimm et al.

(10) Patent No.: US 6,652,680 B2
(45) Date of Patent: Nov. 25, 2003

(54) METHOD FOR PRODUCING TUBES FOR HEAVY GUNS

(75) Inventors: Walter Grimm, Solms (DE); Wolfgang Arrenbrecht, Schwalmtal (DE)

(73) Assignees: Edelstahlwerke Buderus AG, Wetzlar (DE); Rheinmetall W & M GmbH, Unterluess (DE)

( * ) Notice: Subject to any disclaimer, the term of this patent is extended or adjusted under 35 U.S.C. 154(b) by 0 days.

(21) Appl. No.: 10/092,443

(22) Filed: Mar. 8, 2002

(65) Prior Publication Data

US 2002/0124716 A1 Sep. 12, 2002

(30) Foreign Application Priority Data

Mar. 9, 2001 (DE) ..... 101 11 304

(51) Int. Cl.[7] ..... C21D 8/107; C21D 9/10
(52) U.S. Cl. ..... 148/590; 148/593
(58) Field of Search ..... 148/325, 326, 148/590, 593, 594, 909; 420/69

(56) References Cited

U.S. PATENT DOCUMENTS

| | | | | |
|---|---|---|---|---|
| 3,780,465 A | | 12/1973 | Polcha | |
| 4,622,080 A | * | 11/1986 | Wegwerth | 148/591 |
| 4,756,677 A | | 7/1988 | Hribernik et al. | |
| 5,458,704 A | | 10/1995 | Bobbert et al. | |
| 6,564,689 B1 | * | 5/2003 | Billgren | 148/593 |

FOREIGN PATENT DOCUMENTS

WO WO 00/58043 10/2000

* cited by examiner

*Primary Examiner*—Deborah Yee
(74) *Attorney, Agent, or Firm*—Larson & Taylor PLC

(57) ABSTRACT

The method for producing tubes for heavy guns employs a heat-treatable steel, consisting in wt.-% of 0.20 to 0.50% carbon, max. 1.0% silicon, max. 1.0% manganese, max. 0.03% phosphorus, max. 0.03% sulfur, max. 0.1% aluminum, max. 4% nickel, max. 2% chromium, max. 1% molybdenum, max. 0.5% vanadium, and the remainder of iron and the customary impurities. Forgings of open-smelted cast ingots are pre-worked on a lathe on the outside. The solid blanks obtained in this way are hardened and tempered, only subsequently drilled and then finished.

3 Claims, 1 Drawing Sheet

METHOD FOR PRODUCING TUBES FOR HEAVY GUNS

BACKGROUND AND SUMMARY OF THE INVENTION

The invention relates to a method for producing cannon and gun tubes of 105 to 120 mm caliber and greater.

The standard material for these products is the steel 35NiCrMoV 12-5, Material No. 1.6959, described in the Stahl-Eisen-Liste [Steel-Iron List] of the publishers Stahleisen, Düsseldorf, and in the material data sheet "Rohrstahl für schwere Geschütze" [Steel for Tubes of Heavy Guns] of the BWB [German Federal Office of Armaments Technology and Procurement]. The production process for cannon tube blanks comprises the work steps of open smelting, pouring of raw ingots into suitable casting die formats, forging of the cannon tube blanks into exterior rough shapes, annealing the forged pieces, pre-working on a lathe and pre-boring of the parts, heat treatment of the hollow parts (hardening and tempering to the requested strength), measuring the distortion (out of true, i. e. the maximum deviation from the straight line of the longitudinal axis in respect to the bearings at the tube ends) due to hardening, mechanical straightening (trueing) and subsequent annealing to approximately 30° C. below the tempering temperature, performance of quality checks and finishing of the cannon tube blanks to the requested dimensions.

The work step of straightening to obtain trueing after the heat-treating process represents a qualitative problem in the course of the conventional production process, because by this straightening step the straightness of the bore is not achieved and internal ductile strains are induced. Further, after the straightening step it is not possible to straighten a distorted, pre-bored bore in the course of the subsequent boring to the requested size, and remnants of internal stresses still remain in the material in spite of stress-relieving annealing after straightening. It was shown under actual conditions that a) bores out of true and internal strains lead to distortions during the finishing of the tubes, which can only partly be compensated by additional straightening operations, b) waste can be created in the course of processing by dimensional discrepancies on account of the distortions, and c) the firing accuracy (system errors) can become worse on account of deviations from the straightness of the bore and because internal stresses can be released during firing.

As shown by tests in connection with the invention, three main causes are responsible for the distortion during hardening:

1. There can be an asymmetric temperature distribution in the tube blank. It is caused by uneven heating, uneven furnace temperatures or uneven heat distribution. This can be overcome by homogeneous heating and precise temperature distribution in the furnace chamber—a check can be performed by means of thermal elements on the piece. Rotation of the tubes during the entire heat treatment can also aid in this.
2. There may occur a mechanical distortion during heating and austeniting to the hardening temperature. It is created by bending moments during heating in a horizontal position and even in a vertical position if it is a rigid suspension. Such bending moments are the result of inherent weight or horizontal movement during hardening. The distortion can be prevented by suspended (vertical) heat-treating of the tubes by means of suspension from gimbals, so that no bending moments can occur in the tubes at the suspended end in the case of a horizontal movement.
3. A further reason for distortion can be asymmetric transformation strains. In the course of hardening the pre-bored tube blanks the exterior surface as well as the bore are cooled as evenly as possible by the application of water. When the martensitic start temperature of approximately 350° C. has been reached in the material, the austenitic structure begins to be transformed into the martensitic hardening structure. With low distortion hardening, transformation takes place over the entire circumference from the outside (outer surface) toward the inside, and from the inside (bore) toward the outside, until the transformation fronts meet and the entire tube cross section has been hardened. If, because of production, the normal segregation is asymmetric, the transformation processes starting from the bore inevitably start at different times in accordance with the different local analysis situation. This leads to an asymmetric distribution of the transformation strains over the tube cross section and therefore to hardening distortion.

It has been shown in the course of the actual production of cannon tubes that, although the start of transformation at the outer surface takes place symmetrically in the circumferential direction, it does not always do so in the area of the bore. The reason for this primarily lies in the fact that often there is an asymmetry of the bore in relation to the axis of the ingot or in relation to the solidification symmetry of the ingot. FIG. 1 shows a tube in the center position of the raw ingot and its segregation symmetry which will lead to relatively slight distortion when the hollow tube is heat-treated. In contrast, the eccentric position of the tube in relation to the raw ingot shown in FIG. 2 will result in relatively greater distortion.

It is not always possible to avoid an eccentricity of the bore in relation to the former ingot axis because of uneven material flow, which often cannot be prevented, as well as dimensional tolerances (offset) during forging. In consequence, there are asymmetric analysis concentrations, resulting from segregation, in the surface of the bore which cause uneven transformation strains in the interior of the tube leading to distortions.

It is an object of the invention to avoid the inaccuracies mentioned and the production difficulties connected therewith.

The new method proposed for the solution of the above problems is characterized in that the tubes for heavy guns heavy guns in the caliber range of 105 mm and greater are made from heat-treatable steel consisting in wt.-% of 0.20 to 0.50% carbon, max. 1.0% silicon, max. 1.0% manganese, max. 0.03% phosphorus, max. 0.03% sulfur, max. 0.1% aluminum, max. 4% nickel, max. 2% chromium, max. 1% molybdenum, max. 0.5% vanadium, and the remainder of iron and the customary impurities, wherein forgings of open-smelted cast ingots are preworked on a lathe on the outside and the solid blanks obtained in this way are hardened and tempered, subsequently drilled and then finished.

DESCRIPTION OF THE PREFERRED EMBODIMENTS

When producing tubes for heavy guns in accordance with the invention the first working steps preferably are the same as with the prior art described above: open smelting, pouring of raw ingots into suitable casting die formats, forging of the cannon tube blanks into exterior rough shapes, annealing the forged pieces and pre-working the outer surface on a lathe. However, then the next step and characteristic feature of the invention is the heat-treatment of solid blanks, still without bore, instead of pre-treating pre-bored tube pieces. Drilling of the bore follows only subsequently.

With this method the maximum distortion of the blanks, pre-worked on a lathe on the outside only, remains constantly under 10 mm. The available overmeasure of the heat-treated blanks permits the subsequent cutting of the bore in such a way that an exact centricity in relation to the bearings is achieved in the end. The pre-cutting and finishing of the bore is performed on modern deep hole drilling machines and, at customary strengths of >1300 N/mm$^2$, does not require an essentially greater outlay in comparison with the customary process steps of pre-boring in the annealed state (strength<1000 N/mm$^2$) and finish drilling after heat-treating. The mechanical straightening necessary up to now after heat-treating is omitted.

To assure satisfactory heat-treating throughout and sufficient mechanical quality values, a so-called "fat" analysis situation should be set in accordance with the respective cross section to be heat-treated, and a fine-grained even structure should be set by means of temperature- and deformation-controlled forging. The mechanical quality values which can be achieved by this are equivalent to the values obtained with heat-treating of hollow tube pieces.

The production of tank guns from heat-treated, un-straightened, solid pieces drilled only subsequently has shown that a maximum of straightness is achieved and that tubes produced in this way are superior in quality to tubes pre-bored, heat-treated and straightened in the customary manner.

Figure 1:
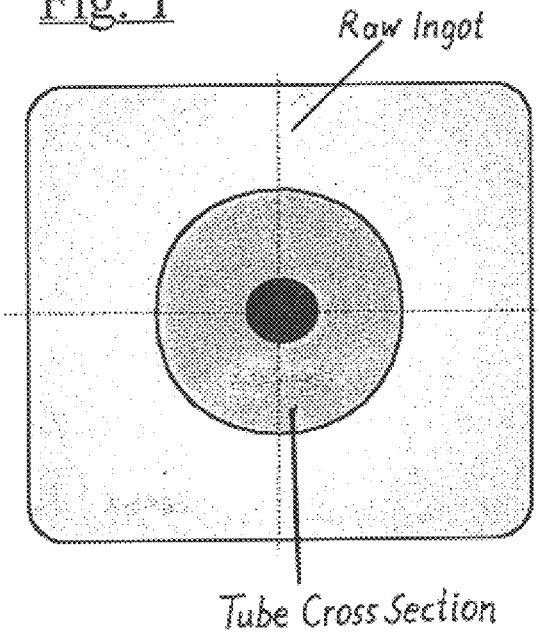
FIG. 1 is an end view of a tube in a slight eccentric center position of a raw ingot where the tube segregation symmetry will result in a slight distortion.
Figure 2:
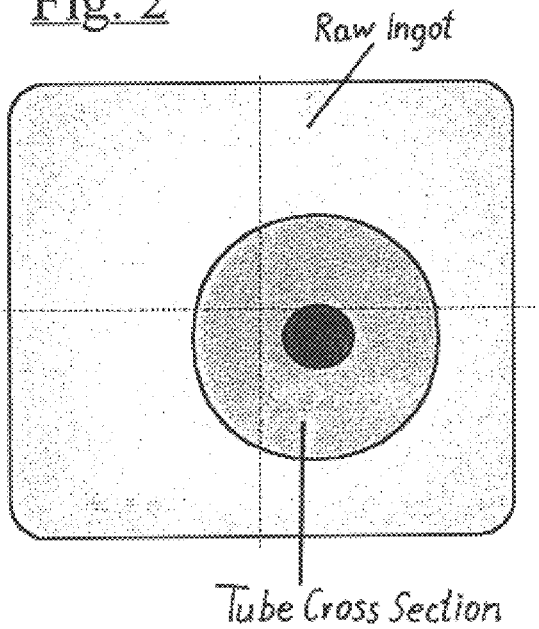
FIG. 2 is an end view of a tube in a greater eccentric center position than that of FIG. 1 where the tube segregation symmetry will result in a relatively greater distortion.
Figure 3:
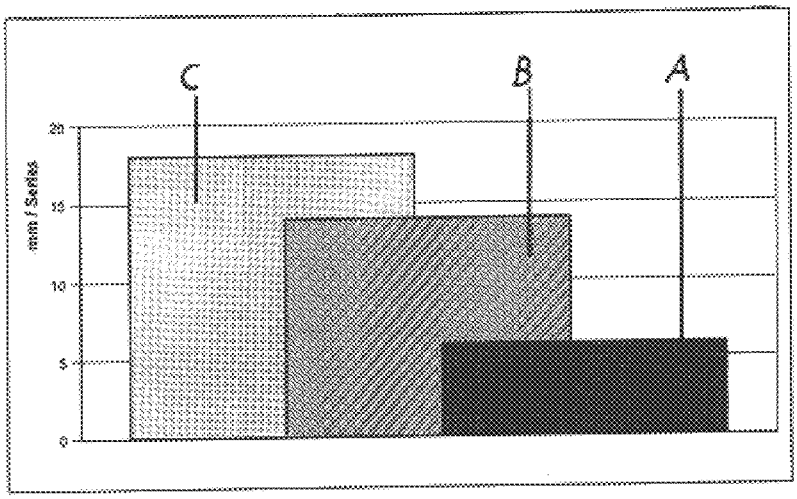
FIG. 3 is a graphical representation of mean values of distortion for differently produced blanks.

This is illustrated in FIG. 3, where at "A" the mean value in mm/series of the distortion (out of true), i.e. the deviation from a straight line, of blanks pre-worked on a lathe, heat-heated as solid pieces and only subsequently drilled in accordance with the invention, is represented next to the mean values shown at "B" and "C" of blanks produced in accordance with the conventional methods. In case "B" the blanks during hardening had been suspended vertically and rotatingly from gimbals whereas in case "C" they had been suspended rigidly in vertical position. The freely moveable vertical suspension of case "B" is also preferred for the heat-treatment of the solid blanks in accordance with the invention.

Starting from the steel composition mentioned above, a preferred steel for the new method consists of 0.30 to 0.40% carbon, 0.15 to 0.35% silicon, 0.40 to 0.70% manganese, max. 0.015% phosphorus, max. 0.010% sulfur, max. 0.015% aluminum, 2.50 to 3.50% nickel, 1 to 1.40% chromium, 0.35 to 0.60% molybdenum, 0.08 to 0.20% vanadium, and the remainder of iron and the customary impurities, and still more preferably of 0.30 to 0.35% carbon, 0.15 to 0.20% silicon, 0.60 to 0.70% manganese, max. 0.010% phosphorus, max. 0.005% sulfur, max. 0.015% aluminum, 3.30 to 3.50% nickel, 1.20 to 1.35% chromium, 0.45 to 0.55% molybdenum, 0.15 to 0.20% vanadium, max. 0.12% copper, max. 0/015% tin and the remainder of iron and the customary impurities.

What is claimed is:

1. A method for producing tubes for heavy guns in the caliber range of 105 mm and greater, made from heat-treatable steel, consisting in wt.-% of 0.20 to 0.50% carbon,
max. 1.0% silicon,
max. 1.0% manganese,
max. 0.03% phosphorus,
max. 0.03% sulfur,
max. 0.1% aluminum,
max. 4% nickel,
max. 2% chromium,
max. 1% molybdenum,
max. 0.5% vanadium,
and the remainder of iron and the customary impurities,
said method comprising the steps of
providing a forging of a open-melted cast ingot of said steel,
pre-working the outside of said forged cast ingot on a lathe to prepare a solid blank,
heat treating said solid blank by hardening and tempering,
drilling a bore in said heat treated blank to form a tube, and
finishing said tube to the desired dimensions.

2. The method in accordance with claim 1, characterized in that a heat-treatable steel is used consisting of 0.30 to 0.40% carbon,
0.15 to 0.35% silicon,
0.40 to 0.70% manganese,
max. 0.015% phosphorus,
max. 0.010% sulfur,
max. 0.015% aluminum,
2.50 to 3.50% nickel,
1 to 1.40% chromium,
0.35 to 0.60% molybdenum,
0.08 to 0.20% vanadium,
and the remainder of iron and the customary impurities.

3. The method in accordance with claim 2, characterized in that a heat-treatable steel is used consisting of 0.30 to 0.35% carbon,
0.15 to 0.20% silicon,
0.60 to 0.70% manganese,
max. 0.010% phosphorus,
max. 0.005% sulfur,
max. 0.015% aluminum,
3.30 to 3.50% nickel,
1.20 to 1.35% chromium,
0.45 to 0.55% molybdenum,
0.15 to 0.20% vanadium,
max. 0.12% copper,
max. 0.015% tin
and the remainder of iron and the customary impurities.

* * * * *